United States Patent [19]

Kutz et al.

[11] Patent Number: 4,506,526

[45] Date of Patent: Mar. 26, 1985

[54] APPARATUS FOR TREATING WEBS OF MATERIAL

[75] Inventors: Johannes Kutz, Tönisvorst; Dieter Itgenhorst, Krefeld; Julius Kohnen, Tönisvorst, all of Fed. Rep. of Germany

[73] Assignee: Eduard Kusters, Krefeld, Fed. Rep. of Germany

[21] Appl. No.: 546,947

[22] Filed: Oct. 31, 1983

[30] Foreign Application Priority Data

Oct. 9, 1982 [DE] Fed. Rep. of Germany ..... 3237507
Dec. 24, 1982 [DE] Fed. Rep. of Germany ..... 3248048
Jul. 6, 1983 [DE] Fed. Rep. of Germany ..... 3324352

[51] Int. Cl.[3] ..... D06B 3/12
[52] U.S. Cl. ..... 68/15; 68/158; 68/175; 68/183
[58] Field of Search ..... 68/9, 15, 43, 46, 47, 68/158, 175, 176, 177, 181 R, 183; 118/419, 420, 427; 134/64 R, 64 P, 122 R, 122 P

[56] References Cited

U.S. PATENT DOCUMENTS 4,034,389 7/1977 Huss ..... 134/122 P X
4,182,142 1/1980 Sando et al. ..... 68/183 X

FOREIGN PATENT DOCUMENTS 16350 10/1980 European Pat. Off. ..... 68/177
422428 12/1925 Fed. Rep. of Germany ..... 68/177
720956 5/1942 Fed. Rep. of Germany ... 134/122 R
1411323 8/1965 France ..... 68/177
25768 12/1963 Japan ..... 68/175
432094 7/1935 United Kingdom ..... 68/43

*Primary Examiner*—Philip R. Coe
*Attorney, Agent, or Firm*—Kenyon & Kenyon

[57] ABSTRACT

Apparatus for treating webs of material with several buoyant rolls which engage the web of material, consist of a closed buoyant body and are arranged in a trough which contains liquid, is open at the top and is at atmospheric pressure, parallel and adjacent to each other horizontally restrained but freely floating in the vertical direction without touching each other. The rolls may be arranged horizontally side by side without forming roll gaps or vertically on top of each other, forming roll gaps with two guide rolls provided above each buoyant roll.

11 Claims, 6 Drawing Figures

Fig. 5
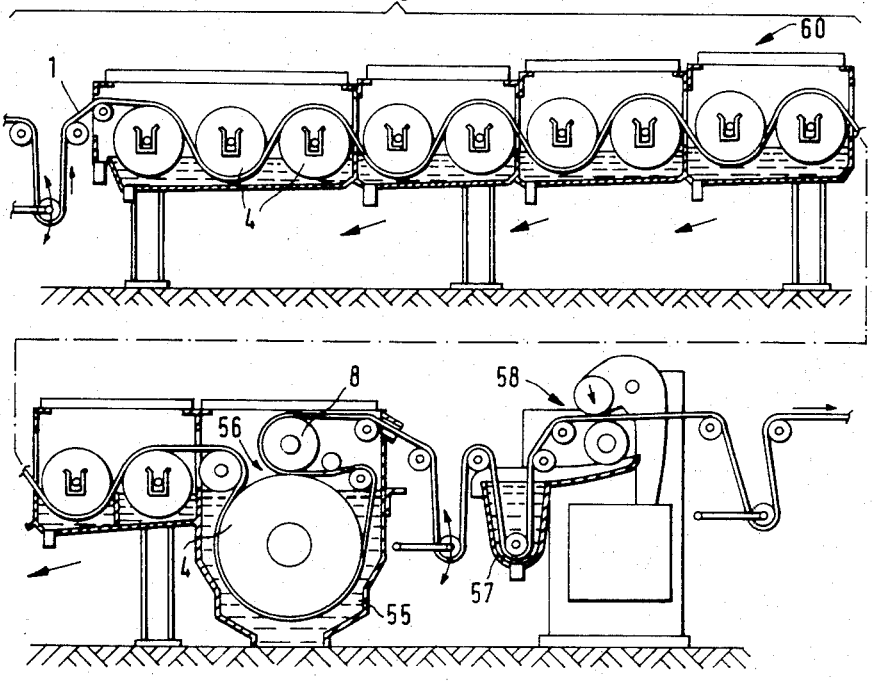
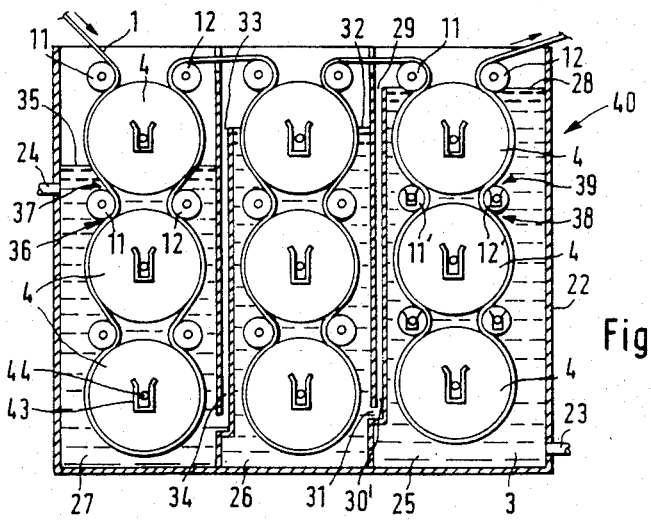
Fig. 6

APPARATUS FOR TREATING WEBS OF MATERIAL

BACKGROUND OF THE INVENTION

This invention relates to apparatus for treating webs of material in general and more particularly to apparatus for treating webs of material with at least one rotatable cylinder which engages the web of material, is freely movable in the vertical direction, but guided in the horizontal plane, the cylinder being in a trough which extends over the length of the cylinder and contains liquid, at least the lower portion of the cylinder immersed in the liquid.

An apparatus of this general nature is described in DE-AS No. 10 87 443. In the known design, the cylinder is sealed all around with respect to the upper edge of the trough and the liquid in the trough is maintained under pressure so that the cylinder is pushed upwards out of the trough while it rests against a counter cylinder arranged on top thereof and, together with the latter, forms a roll gap, in which a web of material which is not sensitive to the moisture on the cylinder, i.e., consists preferably of textiles, can be squeezed out under considerable pressure. The pressure is exerted very uniformly over the width of the web because it is brought about by the uniform pressure of the liquid in the trough. The idea, on which the known design is based, comprises integrating the increase of the pressure in the liquid in order to obtain a correspondingly intensive squeezing-out effect. Due to the long seals, tightness problems arise. A considerable part of the drive power is lost in overcoming the friction at the seals. The operating velocity of the design is limited. The device for generating the pressure represents additional costs.

Apparatus, in which a hollow cylinder floating in a liquid rests from below against two mutually parallel cylinders which are arranged at approximately the same height with lateral spacing and forms roll gaps therewith, is known per se from French Pat. No. 1,123,519.

It is an object of the present invention to simplify apparatus of the type described in DE-AS No. 10 87 443 and to make it also suitable for higher velocities.

SUMMARY OF THE INVENTION

The solution of this problem, according to the present invention, comprises arranging several bouyant rolls each consisting of a closed bouyant hollow body in a trough which contains liquid, is open at the top and is under atmospheric pressure, parallel to each other and adjacent to each other, restrained horizontally, but floating freely in the vertical direction without making contact, and conducting the web of material along the successive rolls.

The fact that the rolls are fixed or restrained in the horizontal direction means that their position in the horizontal plane is defined, so that they occupy, to this extent, an unambiguous position and the web can be conducted without trouble. In the vertical direction, however, the rolls are freely movable. This means that the rolls should be able to give, in an unimpeded manner to the buoyancy forces and to make contact, for instance, with counter cylinders under the action of these forces, to tension the web.

Guide systems for permitting the vertical motion while holding the horizontal position fixed may be, for instance, vertical sliding guides which engage journals provided at the rolls, where, in the present case, however, no external forces are exerted on the rolls. Alternatively, guides with levers which engage journals attached to the rolls extend perpendicular to the rolls axis and are supported tiltably at the free ends and which cause a small displacement of the rolls in the horizontal plane during the upward motion due to the circular guidance, which, however, is negligible with the small excursions under consideration here, may be used.

Since the rolls are to be subjected only to the action of the buoyancy of the liquid, no seals are required because the liquid is not under pressure. For the same reason, devices for generating pressure in the liquid are also eliminated. Because the seals are eliminated, there is also no friction at the roll avoiding accompanying velocity limitations and wear problems. The surface of the rolls need not be faced or ground off as is the case in a roll body which is to cooperate with a sliding seal. It is sufficient if the rolls are made as drums of sheet metal or also of plastic which are reasonably precise at their surface. Care must be taken, of course, that the rolls are as light as possible so that not too much of the buoyancy, which is determined by their volume, is lost by the cylinders' own weight.

The present invention has two aspects: In the first aspect of the present invention, the rolls float freely in the liquid; therefore, there is no roll gap and the buoyancy serves only to support the rolls in the liquid, and they do not exert forces on counter rolls; in the second aspect, the force exerted on the rolls by the buoyancy is utilized for generating a line pressure against counter cylinders, in roll gaps.

An important embodiment of the present invention under the first aspect is one in which the rolls are arranged substantially in the same horizontal plane.

The treatment liquid is at the same time the liquid which generates the buoyancy, i.e., which keeps the rolls which are held in their position by the horizontal guide, in suspension in the liquid. A particularly important effect in such an arrangement is the ease of rotation of the rolls floating in the liquid. Provision must be made, of course, that the horizontal guides do not inhibit this rotatability. In any case, they run considerably easier than rolls which rest with their entire weight on a bearing, whereby inevitably larger resistances to rotation occur.

It is a particularly advantageous effect of the free run that the web of material can be conducted with particularly little tension. This plays a role, for instance, in shrinking devices, in which a web of material is subjected to the action of hot water and should be able to make contact with the rolls guiding it in this process in as uninhibited a manner as possible.

If such a shrinking device is formed by a flat trough, in which several rolls are arranged in tandem in a manner according to the present invention, wherein the web of material is passed alternatiingly over and under successive rolls, and excellent effect is obtained with a minimum of effort.

The tests made have shown that in an arrangement with seven rolls of about 320 mm diameter, the weight of the end of the web of material which is brought out via a deflection roll at the end of the trough and is deposited in a tray, is sufficient, with a fall height of about 1500 mm, to rotate all rolls and even to unwind the web of material from a reel of about 1500 mm diameter preceding the apparatus. The experimental device thus was running completely automatically only due to the height difference between the reel and the tray. In larger plants and with correspondingly heavy reels, an unwinding drive for the roll will, of course, have to be provided.

Anyhow, the fact that approximately 1500 mm of web weight were sufficient to pull the web through the experimental device, gives an idea of the small tension of the web.

Another important item is the fact that the rolls floating in the liquid are not coupled to each other as far as the drive is concerned, so that the web can be shortened or lengthened as required between the individual rolls, whereby no elongations introduced from the outside by the drive of the rolls occur, but the rotation of the rolls and thereby, the web tension, adapt themselves to the conditions entirely automatically.

It has been found that a particularly good liquor exchange at the web can be achieved with this apparatus where below the liquid level, nozzles aimed upward into the corner between the upward running web of material and a roll, through which a fluid medium can be blown under pressure into the liquid, are provided.

This effect is closely related to the low tension guidance of the web of material that can be achieved. The more a web is tensioned, the more difficult it is to remove impurities lodged between the individual fibers of the yarn.

By blowing in a fluid medium, i.e., a liquid or air at this point, a flow in the liquid which is directed into the corner is obtained. However, since the liquid can emerge from the corner only toward the ends, a flow occurs toward both ends of the roll in the axial direction between the web and the cylinder surface by blowing the air in the plane perpendicular to the axis of the cylinder. The flow achieves a transporting effect. For instance, if the apparatus is used for washing and rinsing, the impurities are transported away efficiently, and new liquor is continuously transported to the web. This is also important in dyeing webs of textile material, for instance, in the case of velvet, where excellent results are obtained.

Tests have also shown that the apparatus is highly suitable for dyeing piled articles; for instance, especially velvet and furniture coverings. Particularly uniform dyeing is obtained. By blowing air in, the pile is opened and very good flushing is obtained. One can also proceed by boiling, for which purpose the trough is provided with a lid.

Under its second aspect, i.e., the development of pressure at roll gaps, the present invention can be implemented in a number of ways. A first embodiment of this aspect comprises arranging several rolls immersed in the liquid in the trough in vertically spaced relationship. Optionally a plurality of such rolls can be disposed side by side of each other. Two mutually parallel guide rolls which are arranged in a horizontal plane, have a horizontal spacing from each other and have fixed bearing points are provided for each roll, against which each respective roll in the trough rests from below, forming two roll gaps.

Treatment apparatus is obtained here, in which a multiplicity of roll gaps, through which the web can be conducted successively, can be accommodated in a very small space. It becomes possible thereby to squeeze the liquid out again and again, in apparatus in which the rolls float, and to thereby obtain an intensive interchange of liquid. At the same time, the free runs of the web of material can also be kept small with the rolls packed correspondingly tightly so that apparatus of this kind is particularly well suited for treatments such as mercerizing and similar impregnations. The treatment liquid, i.e., the liquor, is at the same time the support liquid for the rolls.

Two roll gaps are associated with each roll so that in an arrangement of three rolls arranged one over the other and three sets of rolls provided side by side, there are provided eighteen roll gaps with very little expenditure of structural means.

The number of roll gaps can be increased still further in an embodiment in which several rolls immersed in the liquid are arranged in the trough again in vertically spaced relationship and optionally with sets of rolls side by side. Two mutually parallel associated guide rolls which are arranged in a horizontal plane and have a horizontal spacing from each other which is less than the roll diameter, and against which the immersed rolls rest from below, each forming two roll gaps, are provided for each roll. The immersed rolls do not touch each other. The guide rolls, except for the uppermost set, are freely movable in the vertical direction but are guided in the horizontal direction. The lower hollow rolls press the guide rolls from below against hollow rolls located above, forming two additional roll gaps. Here, the lower hollow rolls also push the guide rolls which are freely movable vertically against the underside of the hollow rolls arranged respectively on top thereof, so that two additional roll gaps per roll are produced, and even up to sixty-four squeezing operations can be obtained in the mentioned arrangement.

The apparatus according to the present invention is suitabe for continuous processes, in which, therefore, a web of material runs continuousy through the apparatus and through further preceding and following treatment stations. Then, the web of material is treated only once in the apparatus according to the present invention.

In some cases it may be desirable, however, that the web of material passes through the apparatus according to the present invention several times in succession in the course of a treatment.

This can be accomplished by providing a conveyor device by means of which the web of material can be continuously and endlessly transported back from the last roll as seen in the travel direction to the roll which is first, as seen in the travel direction.

Thereby, the web of material can be conducted back to the start of the trough after it has left the latter, whereafter it passes again through the number of rolls arranged in the trough. However, the web of material must then be endless, i.e., it can have only a limited length. This case happens quite frequently in practice, if limited footages must be subjected to a given treatment.

To increase the length of the web of material to be processed and so that optionally an intermediate dwelling phase outside the trough can be inserted, an embodiment in which an interim storage device is associated with the conveyor device is advisable. This can be realized particularly by depositing a length of the web of material which substantially exceeds the length of the transport distance, on the conveyor device.

A greater length of web material is advantageously deposited on the transporting device by means of a plaiting device following the last roll as seen in the travel direction, by means of which the web of material running out can be deposited in folds on the conveyor device.

For space reasons and also in order not to block the free access to the open roll arrangement in the trough, it is advisable to arrange the conveyor device underneath the trough.

The conveyor device may be designed as a conveyor belt.

By providing a heating device for the liquid in the trough and a cover above the trough, an increase of the temperature of the treatment or support liquid is obtained and excessive evaporation losses prevented.

The buoyancy of the rolls can be increased somewhat by partially evacuating the rolls and providing them with a gas filling which, athough it is under normal pressure, has a lower density, as is the case, for instance, with helium.

BRIEF DESCRIPTION OF THE DRAWINGS

FIG. 5 is a vertical section through a further embodiment of the present invention.

FIG. 6 is a vertical section through an embodiment of the present invention with a multiplicity of squeezing gaps.

DETAILED DESCRIPTION

Figure 1:
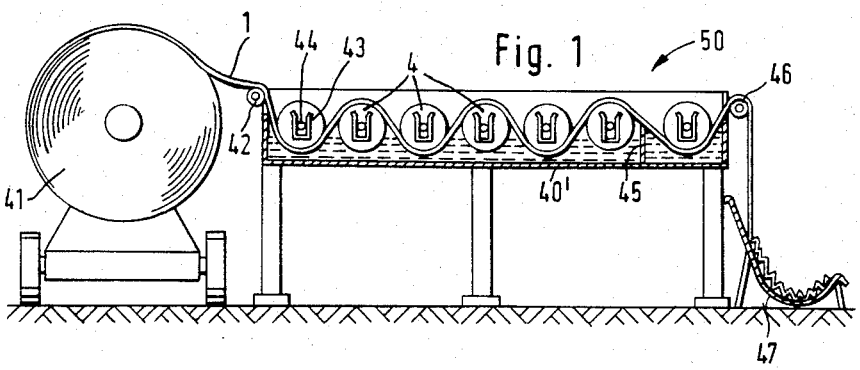
FIG. 1 is a vertical section through apparatus according to the present invention which is suitable as a shrinking device.

The apparatus 50 of FIG. 1 is a shrinking machine. A trough 40' is designed as a shallow tray which is filled with hot water. A web of material 1 to be shrunk is unwound from a reel 41 and is transported via a deflection roll 42 into the trough 40'. In the illustrated embodiment, seven hollow rolls 4 are arranged parallel to each other but without making contact with each other. Rolls 4 are disposed in vertical sliding guides 43 with their journals 44 fixed in the horizontal plane, but freely movable in the vertical direction. The rolls 4 are of a lightweight design in the form closed hollow bodies and float in the hot water in the trough 40'. The web of material 1 is guided under the first roll 4 on the left side of FIG. 1, over the following roll 4, under the third roll 4 etc., in zig-zag fashion. The last roll 4 on the right side is located in a cold water compartment divided off by a weir 45 and is used for cooling down the web of material before it leaves the apparatus. At the end, the web of material 1 is conducted over a deflection roll 46 and then drops into a trough 47. The dropping distance visible on the right-hand side from the deflection roll 46 to the trough 47 is sufficient to set the machine in motion, i.e., to pull the web of material 1 through the hot water. For thick reels 41, a drive must be provided, of course. The bearings of the cylinder journals 44 should, of course, run freely. They may be so-called carbon bearings which are guided in U-profiles open toward the interior of the trough 40' and can slide up and down therein.

In the apparatus 50 of this embodiment, the web of material is subjected only to a very small longitudinal tension, which is favorable for the shrinking process.

In FIg. 5, an apparatus 60 is shown which essentially corresponds to the apparatus 50 and represents the end portion of a dyeing and washing installation, in which the web of material 1 is sequentially conducted through a number of compartments with "floating" rolls 4 and in the process is washed and rinsed.

In the compartment 55 provided at the end, the web of material 1 is rinsed once more in a cold rinsing solution. It surrounds a floating roll 4 which cooperates with a fixed roll 8 which is arranged above it forming a roll gap 56, to squeeze out the rinsing liquid to a rather high percentage. The web of material 1 is then post-rinsed once more with clear cold water in a trough 57 and then squeezed in a high performance squeezing mechanism 58.

In the embodiment of apparatus 60, both aspects of the present invention are realized, namely, in the compartment 55 the formation of a line pressure by means of the buoyancy acting in the liquid on the roll 4 and the floating support of the rolls 4 under the action of the buoyancy, in the liquid, for obtaining a resistance to rotation as low as possible and a small web tension.

Figure 2:
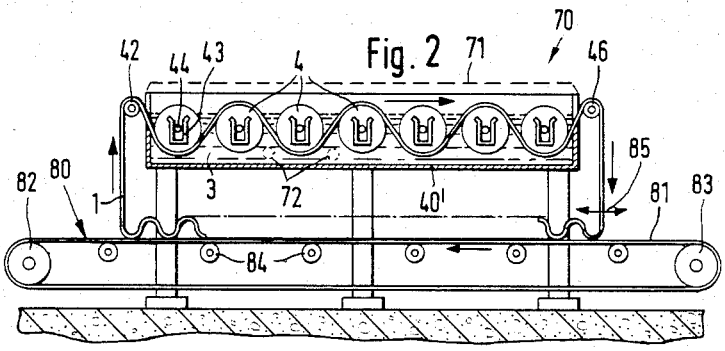
FIG. 2 is a vertical section through apparatus according to the present invention with which a return device is associated, so that batch merchandise can be conducted through the trough several times.

The apparatus 70 of FIG. 2 corresponds in its upper part to that of FIG. 1, but under the trough 40' a conveyor device 80 is provided and comprises a horizontal conveyor belt 81 which is endless and revolves via deflection rolls 82 and 83 parallel to the longitudinal direction of the trough 40' and extends over the length thereof. The upper section of the conveyor belt 81 is supported by support rolls 84.

The section of the web of material led off from the deflection roll 46 downward reaches the conveyor belt 81 and is transported by the belt in the direction of the arrow under the trough 40' up to its start, where the web of material lying on the conveyor belt is pulled up to the deflection roll 42.

So that an appropriate footage can be processed, it is advisable to use the conveyor belt as intermediate storage device and to deposit the web of material 1 in folds thereon by means of a plating device 85.

Depending on the quantity of the web of material 1 deposited on the conveyor belt 81, a longer or shorter dwelling time is obtained between the deflection rolls 46 and 42, which likewise may be desired for different treatments.

Instead of using the conveyor belt itself as the intermediate storage device, a separate intermediate storage device can also be provided, for instance, in the form of a trough for material (such as trough 42 of FIG. 1) into which the web of material 1 runs after passing the deflection roll 46 and from which it is drawn by the conveyor device.

Figure 3:
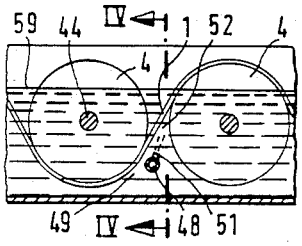
FIG. 3 is an enlarged detail from FIG. 1 as a section along line III—III of FIG. 4.
Figure 4:
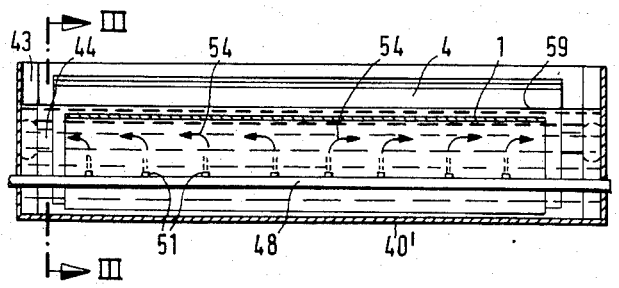
FIG. 4 is a section along the line IV—IV of FIG. 3.

An important addition to the apparatus 50, 60, or 70 of FIGS. 1, 5 and 2 is shown in FIGS. 3 and 4. It is used to intensify the treatment attack of the liquid 3 at the web of material 1.

The addition consists of attaching a nozzle tube 48 which is disposed in the liquid 3 between two rolls 4. Nozzles 51 in the the nozzle tube 48 are aimed upward into the corner 52 between the upwardly travelling section of the web of material 1 and the following roll 4. Through the nozzle tube 48, a fluid medium, for instance, the liquid in the trough 40' or air can be blown out, whereby a flow aimed into the corner 52 is obtained which, because the corner area is closed off on the one hand by the roll 4 and on the other hand by the web of material 1, is deflected by the web of material 1 in the direction of the arrows 54 in FIG. 4 and leads to a motion of the liquid parallel to the web of material 1 and to a transporting action from the web of material 1 toward the sides of the apparatus. Since the web of material 1 is under only very little longitudinal tension, an intensive liquor exchange takes place in the web of material 1 and, in particular, a good washing and rinsing action.

If dyeing in the boiling temperature range is desired in the apparatus and the liquid 3 is therefore a boiling dyeing liquid, the trough 40' is provided with a cover 71 which is indicated dashed in FIG. 2. The then required heating device for the dyeing liquid is shown schematically in FIG. 2 by only two heating tubes 72.

For treatment in apparatus 50, 60, and 70, the types of webs of textile material which are predominantly treated are, for instance, knitted goods. However, the apparatus 50, 60, 70 is not limited to the use of webs of textile material. For instance, non-woven bonded fabric or paper webs in certain cases require wetting or impregnation treatments which can be carried out in the apparatus described.

The apparatus 40 of FIG. 6 is used for impregnating webs of textile material, and especially for mercerizing. The trough 22 is designed as a box-shaped liquid container which has a liquid input 23 and a liquid discharge 24. In the trough, three compartments 25, 26, and 27 are formed, in each of which three rolls 4 are arranged on top of each other. The mercerizing liquor enters the compartment 25 at 23 and fills the latter up to a filling level 28, from which it flows, via an overflow 29 and a canal 30 with an opening 31, into the compartment 26 which has a somewhat lower filling level 32. From the compartment 26, the liquid passes from an overflow 33 through a canal 34 into the compartment 27 which again has a lower filling level 35.

In the mercerizing liquor 3, closed cylindrical barrels formed by rolls 4 of thin sheet metal which are accordingly light have, at their end faces, journals 44 which are guided in vertical guides 43 which are fastened on the inside of the ends of trough 22. The rolls 4 can move freely vertically in the vertical guides 43, but are prevented thereby from horizontal displacement. The lower two rolls 4 of each compartment are immersed completely and the topmost roll 4 of each compartment partially in the mercerizing liquor 3.

The rolls 4 are subjected to buoyancy in the mercerizing liquor 3. They are made substantially lighter than the displaced amount of liquid, so that the buoyancy leads to a resultant force on the rolls 4 which urges them upward and out of the liquid.

With each roll 4 are associated two guide rolls 11 and 12 which are arranged parallel at the same height and which are in contact with the roll 4 below under the action of the buoyancy. In the compartments 26 and 27, the guide rolls 11 and 12 are fixed in the trough 22. The lower guide rolls 11 and 12 have a small spacing from the rolls 4 located above them, so that, while a roll gap is formed with the respective roll 4 underneath, as indicated at 36, this is not the case at the point 37 between the guide rolls 11 and 12 and the rolls 4 on top thereof.

The web of material 1 is conducted through the apparatus in the direction indicated by the arrow, i.e., on the outer side located at the left in the drawing, from the top to the bottom along the rolls 4 in compartment 27, around the lowest roll 4 and upward again, and is then continued in the compartment 26 again from the top down and on the right-hand side from the bottom up. For each roll 4, two roll gaps are obtained in this embodiment, because the guide rolls 11 and 12 are fixed and spaced a distance from the respective roll 4 on top thereof.

In the compartment 25 which is on the right in FIG. 6, an alternative embodiment is shown, in which only the topmost guide rolls 11 and 12 are fixed. The guide rolls 11 and 12, like the rolls 4, are freely movable vertically in appropriate guides. Under the action of the buoyancy, the entire stack is pushed upward, the guide rolls 11 and 12 making contact with the upper as well as with the lower adjacent roll 4. Therefore, there are roll gaps at the points 38 as well as the points 39, i.e., four roll gaps for each roll 4. In this manner, the number of squeezing gaps which can be accommodated in a small space can be increased still further.

With the described flow direction of the liquor through the trough 22 and the indicated web travel direction, a counter-directional flow is obtained. The diameters of the rolls 4 may, in practice, be 300 to 500 mm, and the diameters of the guide rolls 11 and 12 may be 80 to 200 mm.

It goes without saying that the alternative embodiments can be combined in the manner shown in FIG. 6, but that the entire apparatus can also be realized only in the one or the other manner. Also combinations of the arrangement shown in FIG. 6 with devices corresponding to the devices 50, 60 and 70 can be considered.

What is claimed is:

1. Apparatus for treating webs of material comprising:

a trough, which contains liquid, having a bottom, sides and open top such that the liquid is under atmospheric pressure;

several rotatable bouyant rolls, each comprising a closed bouyant hollow body, arranged in said trough parallel to each other and adjacent to each other;

means guiding said rolls in the horizontal plane but allowing them to float freely in the vertical direction without making contact, said bouyant rolls arranged floating in said liquid such that all are substantially in the same horizontal plane;

means conducting the web of material along the successive bouyant rolls looped around said rolls in zig-zag fashion; and nozzles located below the liquid level and aimed upward into the corners between upward running parts of the web material and said rolls, said nozzles adapted to have a fluid medium blown therethrough under pressure into the liquid.

2. Apparatus for treating a web of material comprising:

a tank which contains liquid having a bottom, sides and an open top such that the liquid is under atmospheric pressure;

several rotatable bouyant rolls each comprising a closed bouyant hollow body arranged in said tank in vertical spaced relationship;

a plurality of pairs of mutually parallel guide rolls disposed in horizontal spaced relationship, with the spacing between the guide rolls of each pair being less than the bouyant roll diameter, one pair associated with each roll, and each pair disposed such that its respective bouyant roll rests against the pair of guide rolls from below;

fixed bearing points supporting the uppermost guide rolls in a fixed manner; and means supporting the remaining guide rolls so as to be freely movable in the vertical direction but to be guided in the horizontal direction, whereby the lower bouyant rolls will press against the guide rolls from below, thereby pressing them against the bouyant rolls located above, forming two additional roll gaps for each but the bottommost bouyant roll.

3. Apparatus according to claim 2 wherein a plurality of groups of several bouyant rolls are disposed side by side.

4. Apparatus according to one of the claims 1 or 2, and further including a conveying device, by means of which the web of material can be transported back from the last roll as seen in the travel direction, continuously and endlessly to the roll which is first, as seen in the travel direction.

5. Apparatus according to claim 4, and further including an interim storage device associated with the conveying device.

6. Apparatus according to claim 4, wherein a length of the web of material which substantially exceeds the length of the transport distance, is carried on the conveying device.

7. Apparatus according to claim 6, and further including a plaiting device following the last roll as seen in the travel direction, by means of which the web of material running out can be deposited in folds on the conveying device.

8. Apparatus according to claim 4, wherein the conveying device is arranged underneath the trough.

9. Apparatus according to claim 4, wherein the conveying device comprises at least one conveyer belt extending at least over the length of the trough.

10. Apparatus according to claim 4, and further including a heating device for the liquid arranged in the trough and a cover above the trough.

11. Apparatus according to one of the claims 1 or 2, wherein each roll is partially evacuated or is provided with a gas filling with a density less than the density of air at normal pressure.

* * * * *